US009462645B1

(12) United States Patent
Cai et al.

(10) Patent No.: US 9,462,645 B1
(45) Date of Patent: Oct. 4, 2016

(54) LED DRIVER CIRCUIT WITH STEPWISE ADJUSTABLE POWER AND LED LIGHTING TUBE

(71) Applicants: Haibin Cai, Guangdong Province (CN); Wenhong Ling, Guangxi (CN)

(72) Inventors: Haibin Cai, Guangdong Province (CN); Wenhong Ling, Guangxi (CN)

( * ) Notice: Subject to any disclaimer, the term of this patent is extended or adjusted under 35 U.S.C. 154(b) by 0 days.

(21) Appl. No.: 14/828,534

(22) Filed: Aug. 18, 2015

(51) Int. Cl.
*H05B 37/02* (2006.01)
*H05B 33/08* (2006.01)

(52) U.S. Cl.
CPC ..... *H05B 33/0815* (2013.01); *H05B 33/0812* (2013.01)

(58) Field of Classification Search
CPC .. H05B 37/02; H05B 33/08; H05B 33/0809; H05B 33/0815; H05B 33/0842
USPC ..... 315/209 R, 224–226, 276, 291, 307, 308
See application file for complete search history.

(56) References Cited

U.S. PATENT DOCUMENTS 8,941,319 B2 * 1/2015 Gao ..... H05B 33/0809 315/219
2014/0062319 A1 * 3/2014 Huang ..... H05B 33/0815 315/186

* cited by examiner

*Primary Examiner* — Jimmy Vu
(74) *Attorney, Agent, or Firm* — Prakash Nama; Global IP Services, PLLC

(57) ABSTRACT

An LED driver circuit with stepwise adjustable power and an LED lighting tube. The LED driver circuit comprises a constant current IC chip U1, a power supply unit connecting to the constant current IC chip U1, a switch control unit and a driving unit. The driving unit connects to the switch control unit. The LED driver circuit also comprises a power regulation unit. The power regulation unit connects to the constant current IC chip U1, the switch control unit and the driving unit. The present invention uses 12 W, 15 W, 18 W (or) more stepwise adjustable power. It is applicable to LED lighting tubes, ceiling lights, panel lights and all types of LED stepwise adjustable power.

9 Claims, 3 Drawing Sheets

LED DRIVER CIRCUIT WITH STEPWISE ADJUSTABLE POWER AND LED LIGHTING TUBE

BACKGROUND OF THE INVENTION

The present invention relates to LED lighting apparatus and particularly relates to an LED driver circuit with stepwise adjustable power and an LED lighting tube.

LED lighting tube is commonly known as light tube or fluorescent tube. Its light source adopts LED as illuminant. Traditional fluorescent tube is also called fluorescent light. The light is provided with a filament on both ends. The light tube is filled with a small amount of argon and mercury vapor. Fluorescent powder is coated on the inner wall of the light tube. Gases between the two filaments emit ultraviolet light when they are conductive, causing the fluorescent powder to emit visible light. LED lighting tube has many advantages. It is commonly used for general lighting and indoor lighting in offices, malls, restaurants, schools, homes, factories and so forth.

An LED lighting tube usually comprises a light cover, LED beads, aluminum substrate, power supply and so forth. At present, there have been LED lighting tubes with SCR dimming, remote controlled dimming and adjustable power. However, since the said LED lighting tubes are additionally provided with dimming circuits, loss also increases, thus reducing power conversion efficiency. Since power conversion efficiency decreases, lumen of the whole LED lighting tubes also decreases. The cost is higher and it is not beneficial for energy-saving and environmental protection.

BRIEF SUMMARY OF THE INVENTION

An object of the present invention is to provide an LED driver circuit with stepwise adjustable power. It uses 12 W, 15 W, 18 W (or) more stepwise adjustable power. It is applicable to LED lighting tubes, ceiling lights, panel lights and all types of LED stepwise adjustable power. It can guarantee power conversion efficiency and achieve adjustment of the power of the LED lighting tube as well as selection of an appropriate power, thereby effectively providing the benefits of energy-saving and environmental friendliness to consumers.

To achieve the aforementioned object, the present invention adopts the following technical proposal:

An LED driver circuit with stepwise adjustable power, comprising a constant current IC chip U1, a power supply unit connecting to the constant current IC chip U1, a switch control unit and a driving unit. The driving unit connects to the switch control unit. The LED driver circuit also comprises a power regulation unit. The power regulation unit connects to the constant current IC chip U1, the switch control unit and the driving unit.

Furthermore, in the LED driver circuit with stepwise adjustable power described above, the power supply unit comprises a 300V voltage input, a resistor R3, a resistor R4, a resistor R5, a capacitor C1, a diode D1, a capacitor C5 and a resistor R10. An internal multiplier input pin MULT of the constant current IC chip U1 connects to the 300V voltage input via the resistor R4 and the resistor R5. A zero current detection pin ZCD of the constant current IC chip U1 is grounded via the resistor R10. The capacitor C5 is connected in parallel with two ends of the resistor R10. The diode D1 has a positive pole which is grounded and a negative pole which connects to the zero current detection pin ZCD of the constant current IC chip U1.

Furthermore, in the LED driver circuit with stepwise adjustable power described above, each of the resistor R3 and the capacitor C1 has one end which connects to the internal multiplier input pin MULT of the constant current IC chip U1 and another end which is grounded.

Furthermore, in the LED driver circuit with stepwise adjustable power described above, the switch control unit comprises a field effect transistor Q1, a diode D3, a resistor R15, a resistor R16, a resistor R11, a capacitor C8 and a capacitor C10. A grid electrode of the field effect transistor Q1 connects to a grid electrode drive pin GATE of the constant current IC chip U1 via the resistor R15. A drain electrode of the field effect transistor Q1 connects to the 300V voltage input via the diode D3 and the resistor R11. A source electrode of the field effect transistor Q1 connects to a current detection pin CS of the constant current IC chip U1 via the resistor R16.

Furthermore, in the LED driver circuit with stepwise adjustable power described above, the capacitor C8 is connected in parallel with two ends of the resistor R11, and the capacitor C10 is connected between the drain electrode and the source electrode of the field effect transistor Q1.

Furthermore, in the LED driver circuit with stepwise adjustable power described above, the driving unit comprises a transformer T2, a diode D4, a capacitor C14, a resistor R14 and a capacitor C11. A first primary coil of the transformer T2 has one end which connects to the 300V voltage input and another end which connects to the drain electrode of the field effect transistor Q1. A second primary coil of the transformer T2 has one end which connects to the zero current detection pin ZCD of the constant current IC chip U1 and another end which is grounded; A secondary coil of the transformer T2 has one end which connects to a positive pole of an LED load via the resistor R14 and the capacitor C11 and another end which connects to a negative pole of the LED load.

Furthermore, in the LED driver circuit with stepwise adjustable power described above, the diode D4 has a positive pole which connects to one end of the secondary coil of the transformer T2 and a negative pole which connects to one end of the capacitor C14. Another end of the capacitor C14 connects to the negative pole of the LED load.

Furthermore, in the LED driver circuit with stepwise adjustable power described above, the power regulation unit comprises a plurality of switch groups connected in parallel. Each of the switch groups comprises a switch and a resistor connected in series. Each of the switch groups has one end which is grounded and another end which connects to the current detection pin CS of the constant current IC chip U1 via the resistor R16.

Furthermore, in the LED driver circuit with stepwise adjustable power described above, there are three switch groups.

Moreover, the present invention also provides an LED lighting tube. The LED lighting tube comprises a light cover, a power supply provided in the light cover, a circuit board provided with the LED driver circuit with stepwise adjustable power described above and an LED load connected to the LED driver circuit with stepwise adjustable power. The light cover is provided with a power regulating switch. The power regulating switch connects to the LED driver circuit with stepwise adjustable power.

The LED driver circuit with stepwise adjustable power and LED lighting tube of the present invention can guarantee power conversion efficiency and achieve adjustment of the power of the LED lighting tube. It effectively brings down the cost of LED lighting tube and is beneficial for energy-saving and environmental protection.

DETAILED DESCRIPTION OF THE INVENTION

For a better understanding of the present invention, the present invention is further described in detail below with reference to the accompanying drawings. The drawings depict preferred embodiments of the present invention. However, the present invention can be realized in many different forms which are not limited to the embodiments illustrated herein. On the contrary, the purpose of these embodiments is to provide a more thorough and complete understanding of the disclosure of the present invention.

Figure 1:
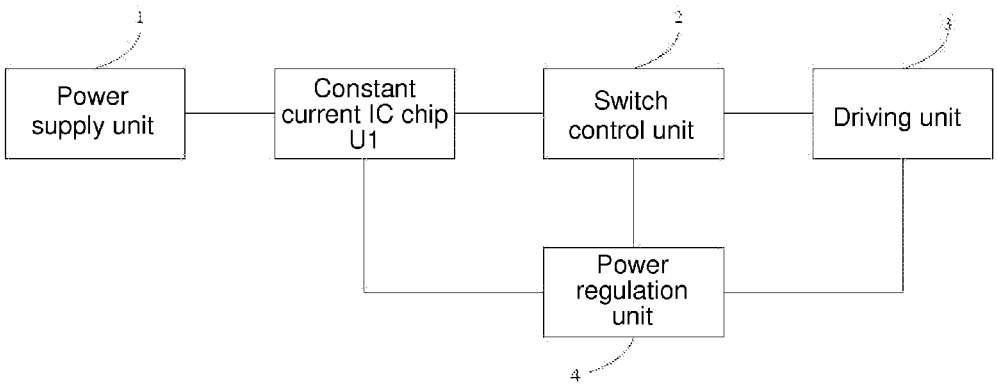
FIG. 1 is a schematic diagram of the LED driver circuit with stepwise adjustable power of the present invention.
Figure 2:
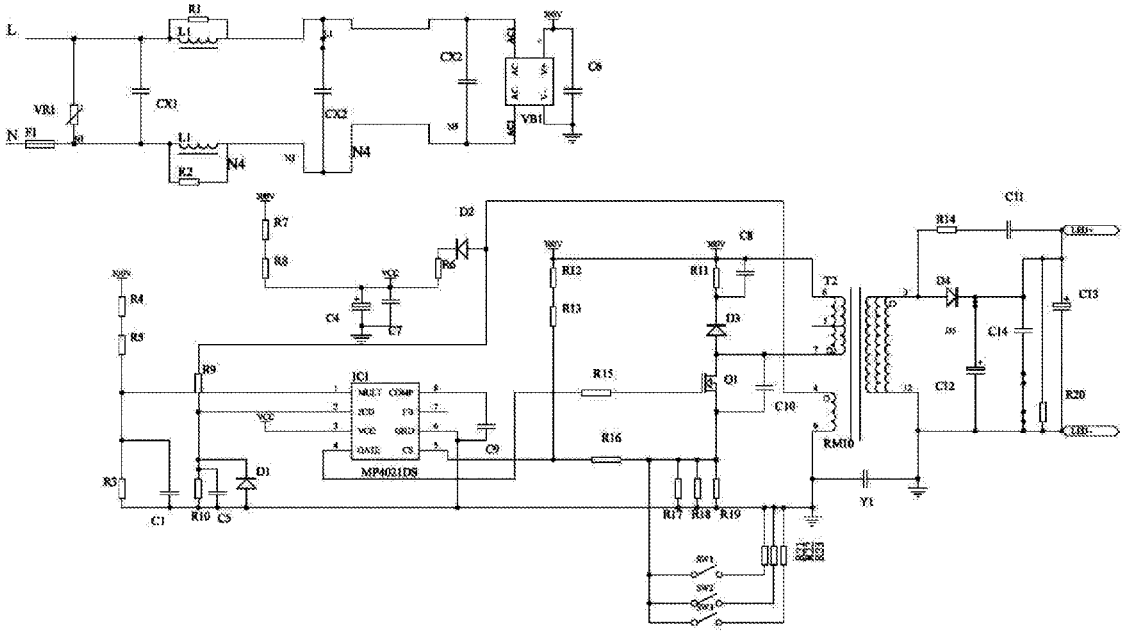
FIG. 2 is a detailed circuit diagram of the LED driver circuit with stepwise adjustable power of the present invention.

As shown in FIGS. 1 and 2, the LED driver circuit with stepwise adjustable power of the present invention comprises a constant current IC chip U1, a power supply unit 1 connecting to the constant current IC chip U1, a switch control unit 2 and a driving unit 3. The driving unit 3 connects to the switch control unit 2. The LED driver circuit also comprises a power regulation unit 4. The power regulation unit 4 connects to the constant current IC chip U1, the switch control unit 2 and the driving unit 3.

The power supply unit 1 comprises a 300V voltage input, a resistor R3, a resistor R4, a resistor R5, a capacitor C1, a diode D1, a capacitor C5 and a resistor R10. An internal multiplier input pin MULT of the constant current IC chip U1 connects to the 300V voltage input via the resistor R4 and the resistor R5. A zero current detection pin ZCD of the constant current IC chip U1 is grounded via the resistor R10. The capacitor C5 is connected in parallel with two ends of the resistor R10. The diode D1 has a positive pole which is grounded and a negative pole which connects to the zero current detection pin ZCD of the constant current IC chip U1.

Each of the resistor R3 and the capacitor C1 has one end which connects to the internal multiplier input pin MULT of the constant current IC chip U1 and another end which is grounded.

The switch control unit 2 comprises a field effect transistor Q1, a diode D3, a resistor R15, a resistor R16, a resistor R11, a capacitor C8 and a capacitor C10. A grid electrode of the field effect transistor Q1 connects to a grid electrode drive pin GATE of the constant current IC chip U1 via the resistor R15. A drain electrode of the field effect transistor Q1 connects to the 300V voltage input via the diode D3 and the resistor R11. A source electrode of the field effect transistor Q1 connects to a current detection pin CS of the constant current IC chip U1 via the resistor R16.

The capacitor C8 is connected in parallel with two ends of the resistor R11, and the capacitor C10 is connected between the drain electrode and the source electrode of the field effect transistor Q1.

The driving unit 3 comprises a transformer T2, a diode D4, a capacitor C14, a resistor R14 and a capacitor C11. A first primary coil of the transformer T2 has one end which connects to the 300V voltage input and another end which connects to the drain electrode of the field effect transistor Q1. A second primary coil of the transformer T2 has one end which connects to the zero current detection pin ZCD of the constant current IC chip U1 and another end which is grounded. A secondary coil of the transformer T2 has one end which connects to a positive pole of an LED load via the resistor R14 and the capacitor C11 and another end which connects to a negative pole of the LED load.

The diode D4 has a positive pole which connects to one end of the secondary coil of the transformer T2 and a negative pole which connects to one end of the capacitor C14. Another end of the capacitor C14 connects to the negative pole of the LED load. In this embodiment, the negative pole of the LED load is grounded.

The power regulation unit 4 comprises a plurality of switch groups connected in parallel. Each of the switch groups comprises a switch and a resistor connected in series. Each of the switch groups has one end which is grounded and another end which connects to the current detection pin CS of the constant current IC chip U1 via the resistor R16.

In this embodiment, there are three switch groups. The power regulation unit 4 comprises a switch SW1, a switch SW2, a switch SW3, a resistor R21, a resistor R22 and a resistor R23. The switch SW1 connects in series with the resistor R21. The switch SW2 connects in series with the resistor R22. The switch SW3 connects in series with the resistor R23.

In this embodiment, the constant current IC chip U1 has a model number of MP4021DS.

The principle of the LED driver circuit with stepwise adjustable power of the present invention is as follows:

During operation, the constant current IC chip U1 controls the output current by sensing the voltage drop of the resistors. The higher the voltage detected by the fifth pin CS, the smaller the power. In contrast, the lower the voltage detected the greater the power. Therefore, when the switch SW1 is closed the resistor R21 is connected; when the switch SW2 is closed the resistor R22 is connected; when the switch SW3 is closed the resistor R23 is connected; power can be adjusted by adjusting the resistance according to the power requirement. As such, the present invention uses 12 W, 15 W, 18 W (or) more stepwise adjustable power. It is applicable to LED lighting tubes, ceiling lights, panel lights and all types of LED stepwise adjustable power. It can guarantee power conversion efficiency and achieve adjustment of the power of the LED lighting tube as well as selection of an appropriate power, thereby effectively providing the benefits of energy-saving and environmental friendliness to consumers.

Figure 3:
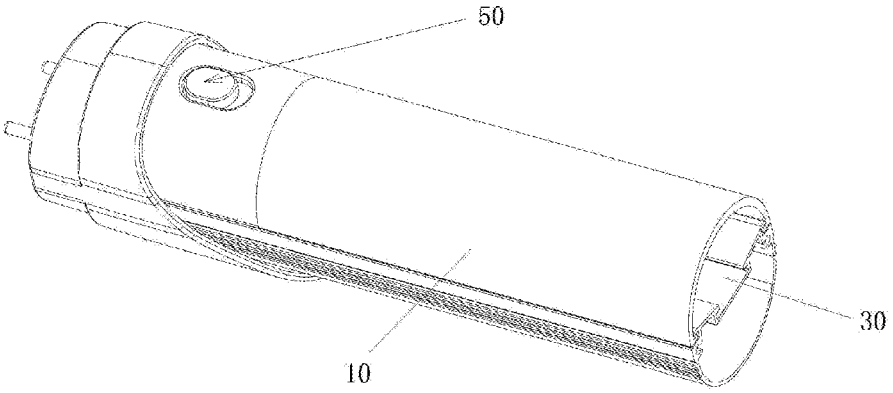
FIG. 3 is a perspective view of the LED lighting tube of the present invention.
Figure 4:
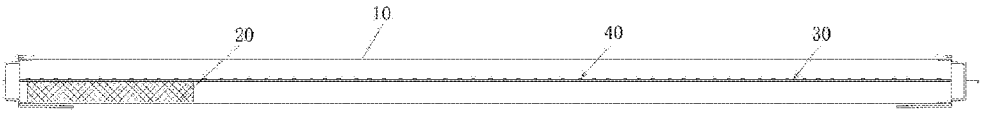
FIG. 4 is a sectional view of the LED lighting tube of the present invention.

Moreover, as shown in FIGS. 3 and 4, the present invention also provides an LED lighting tube which comprises a light cover 10, a power supply 20 provided in the light cover 10, a circuit board 30 provided with the LED driver circuit with stepwise adjustable power described above and an LED load 40 connected to the LED driver circuit with stepwise adjustable power. The light cover 10 is provided with a power regulating switch 50. The power regulating switch 50 connects to the LED driver circuit with stepwise adjustable power.

In comparison with the prior art, the LED driver circuit with stepwise adjustable power and the LED lighting tube of the present invention can guarantee power conversion efficiency and achieve adjustment of the power of the LED lighting tube. It effectively brings down the cost of LED lighting tube and is beneficial for energy-saving and environmental protection.

The description and application of the present invention herein are descriptive. It is not intended that the scope of the invention be limited by the embodiments described above. The embodiments disclosed herein are subject to modifications and changes. It is known to the people having ordinary skill in the art that there are alternative embodiments and equivalents of various components. Those skilled in the art should understand that without departing from the spirit of the invention or essential characteristics thereof, the present invention can be realized in other forms, structures, layouts, ratios as well as by means of other units, materials and components. Without departing from the scope and spirit of the invention, modifications and changes can be made to the embodiments disclosed herein.

What is claimed is:

1. An LED driver circuit with stepwise adjustable power, in that comprising a constant current IC chip U1, a power supply unit connecting to the constant current IC chip U1, a switch control unit and a driving unit, wherein the driving unit connects to the switch control unit; the LED driver circuit also comprises a power regulation unit, and the power regulation unit connects to the constant current IC chip U1, the switch control unit and the driving unit; the power supply unit comprises a 300V voltage input, a resistor R3, a resistor R4, a resistor R5, a capacitor C1, a diode D1, a capacitor C5 and a resistor R10; an internal multiplier input pin MULT of the constant current IC chip U1 connects to the 300V voltage input via the resistor R4 and the resistor R5; a zero current detection pin ZCD of the constant current IC chip U1 is grounded via the resistor R10; the capacitor C5 is connected in parallel with two ends of the resistor R10; the diode D1 has a positive pole which is grounded and a negative pole which connects to the zero current detection pin ZCD of the constant current IC chip U1.

2. The LED driver circuit with stepwise adjustable power as in claim 1, characterized in that each of the resistor R3 and the capacitor C1 has one end which connects to the internal multiplier input pin MULT of the constant current IC chip U1 and another end which is grounded.

3. The LED driver circuit with stepwise adjustable power as in claim 2, characterized in that the switch control unit comprises a field effect transistor Q1, a diode D3, a resistor R15, a resistor R16, a resistor R11, a capacitor C8 and a capacitor C10; a grid electrode of the field effect transistor Q1 connects to a grid electrode drive pin GATE of the constant current IC chip U1 via the resistor R15; a drain electrode of the field effect transistor Q1 connects to the 300V voltage input via the diode D3 and the resistor R11; a source electrode of the field effect transistor Q1 connects to a current detection pin CS of the constant current IC chip U1 via the resistor R16.

4. The LED driver circuit with stepwise adjustable power as in claim 3, characterized in that the capacitor C8 is connected in parallel with two ends of the resistor R11, and the capacitor C10 is connected between the drain electrode and the source electrode of the field effect transistor Q1.

5. The LED driver circuit with stepwise adjustable power as in claim 4, characterized in that the driving unit comprises a transformer T2, a diode D4, a capacitor C14, a resistor R14 and a capacitor C11; a first primary coil of the transformer T2 has one end which connects to the 300V voltage input and another end which connects to the drain electrode of the field effect transistor Q1; a second primary coil of the transformer T2 has one end which connects to the zero current detection pin ZCD of the constant current IC chip U1 and another end which is grounded; a secondary coil of the transformer T2 has one end which connects to a positive pole of an LED load via the resistor R14 and the capacitor C11 and another end which connects to a negative pole of the LED load.

6. The LED driver circuit with stepwise adjustable power as in claim 5, characterized in that the diode D4 has a positive pole which connects to one end of the secondary coil of the transformer T2 and a negative pole which connects to one end of the capacitor C14; another end of the capacitor C14 connects to the negative pole of the LED load.

7. The LED driver circuit with stepwise adjustable power as in claim 6, characterized in that the power regulation unit comprises a plurality of switch groups connected in parallel; each of the switch groups comprises a switch and a resistor connected in series; each of the switch groups has one end which is grounded and another end which connects to the current detection pin CS of the constant current IC chip U1 via the resistor R16.

8. The LED driver circuit with stepwise adjustable power as in claim 7, characterized in that there are three switch groups.

9. An LED lighting tube, comprising a light cover, a power supply provided in the light cover, a circuit board of the LED driver circuit with stepwise adjustable power according to any one of claims 1 and 2-8, and an LED load connected to the LED driver circuit with stepwise adjustable power, the light cover is provided with a power regulating switch; the power regulating switch connects to the LED driver circuit with stepwise adjustable power.

* * * * *